US006250834B1

(12) United States Patent
Wien

(10) Patent No.: US 6,250,834 B1
(45) **Date of Patent: *Jun. 26, 2001**

(54) VERSATILE BINDER ASSEMBLY WITH AN EXTERIOR POCKET(S)

(75) Inventor: Thomas Wien, Newport Beach, CA (US)

(73) Assignee: Avery Dennison Corporation, Pasadena, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/334,581

(22) Filed: Jun. 16, 1999

(51) Int. Cl.[7] ..... B42F 13/00

(52) U.S. Cl. ..... 402/73; 402/70; 281/29; 281/31; 281/36; 281/37

(58) Field of Search ..... 281/29, 31, 36, 281/45; 402/70, 73; D19/26, 28

(56) References Cited

U.S. PATENT DOCUMENTS

| | | | |
|---|---|---|---|
| 156,588 | 11/1874 | Mets . | |
| D. 339,821 | 9/1993 | Ohnishi | D19/26 |
| 405,874 | 6/1989 | Collins . | |
| 418,327 | 1/2000 | Sullins et al. . | |
| 575,809 | 1/1997 | O'Riva . | |
| 818,202 | 4/1906 | Sweet . | |
| 1,037,264 | 9/1912 | Kimmel . | |
| 1,359,320 | 11/1920 | Brenan . | |
| 1,848,980 | 3/1932 | Walker . | |
| 2,088,953 | 8/1937 | Greer . | |
| 2,417,322 | 3/1947 | Plotzky | 150/117 |
| 2,496,128 | 1/1950 | Lifton | 190/111 |
| 2,544,566 | 3/1951 | Rose . | |
| 2,677,376 | 5/1954 | Brunner . | |
| 2,860,680 | 11/1958 | Chase | 150/117 |
| 3,565,462 | 2/1971 | Gottlieb . | |
| 3,814,527 | 6/1974 | Lawes . | |
| 4,004,689 | 1/1977 | Glasell . | |
| 4,629,349 | 12/1986 | Pitts . | |
| 4,639,157 | 1/1987 | Herzfeld . | |
| 4,790,484 | 12/1988 | Mitsuyama . | |
| 4,824,273 | 4/1989 | Silva et al. . | |
| 4,838,724 | 6/1989 | Spence, Jr. . | |
| 4,892,333 | 1/1990 | Krulich . | |
| 4,961,596 | 10/1990 | Moor . | |
| 4,964,508 | 10/1990 | Balsley . | |
| 5,183,294 | 2/1993 | Jukola et al. . | |
| 5,219,437 | 6/1993 | Moor et al. . | |
| 5,236,226 | 8/1993 | Sheffield . | |
| 5,240,340 | 8/1993 | Lynch et al. . | |
| 5,261,701 | 11/1993 | Walters . | |
| 5,330,279 | 7/1994 | Ruble . | |
| 5,350,249 | 9/1994 | Peters . | |
| 5,370,419 | 12/1994 | Takayama . | |
| 5,411,293 | 5/1995 | Monzyk | 281/31 |
| 5,494,366 | 2/1996 | Pell et al. . | |
| 5,671,950 | 9/1997 | Hanson . | |
| 5,676,482 | 10/1997 | Hawkins . | |
| 5,704,646 | 1/1998 | Tzeng . | |
| 5,711,627 * | 1/1998 | Chapman | 281/31 X |
| 5,720,564 | 2/1998 | Winzen | 402/70 X |
| 5,749,666 | 5/1998 | Yu . | |
| 5,823,574 | 10/1998 | Sullins et al. . | |

(List continued on next page.)

*Primary Examiner*—Willmon Fridie, Jr.
(74) *Attorney, Agent, or Firm*—Oppenheimer Wolff & Donnelly LLP

(57) ABSTRACT

A binder with at least one exterior pocket that extends along the outer exposed side of the binder is disclosed to provide additional capacity to provide easy access to selected papers, or to securely hold oversize sheets of paper, or items that are too bulky or excess items that would not fit between the binder covers. In accordance with another embodiment of the present invention, an elastic cord may be coupled along the opening of the exterior pocket to provide additional tension along the pocket opening to securely seal the items held in the pocket.

23 Claims, 3 Drawing Sheets

U.S. PATENT DOCUMENTS 5,876,143 3/1999 Ong .
5,911,441 6/1999 Yamamoto et al. .
5,951,189 * 9/1999 Winzen ..... 281/29 X
5,975,578 * 11/1999 Mayer ..... 281/29 X
6,017,062 1/2000 White .
6,024,508 2/2000 Lippeth et al. .

* cited by examiner

FIG. 4
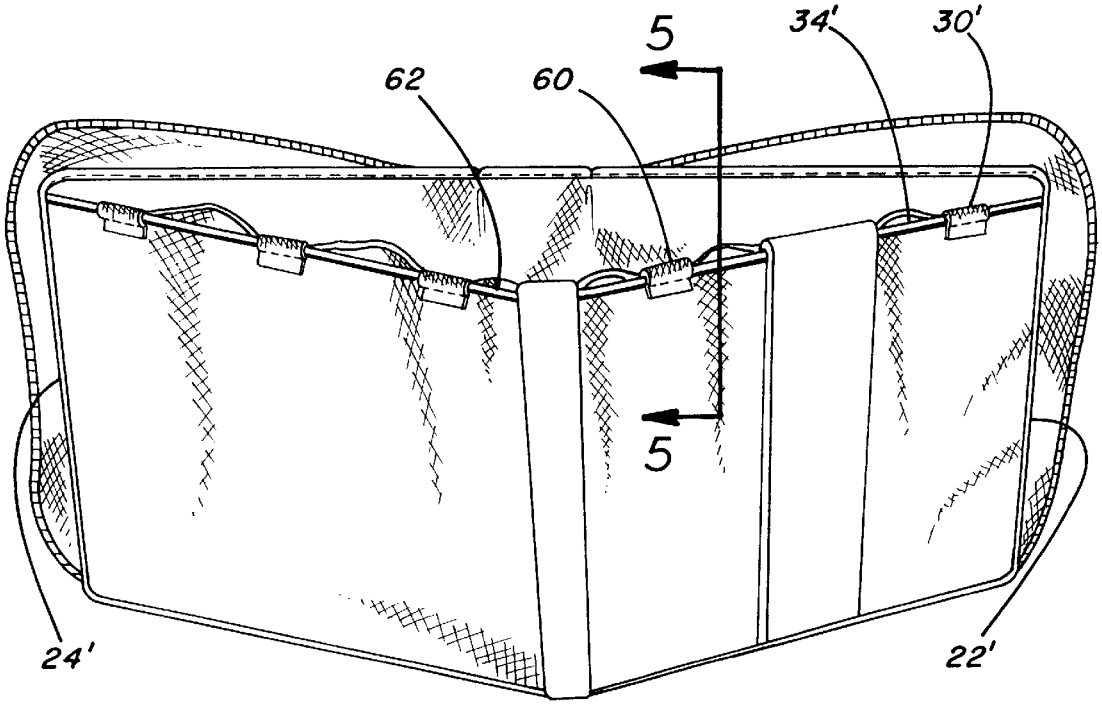
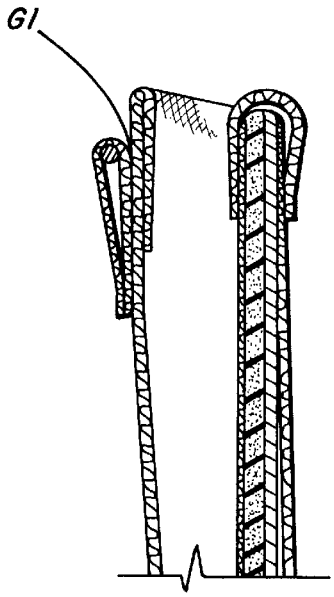
FIG. 5

VERSATILE BINDER ASSEMBLY WITH AN EXTERIOR POCKET(S)

BACKGROUND OF THE INVENTION

1. Field of Invention

This invention relates generally to a binder and, more particularly, to a versatile binder with at least one exterior pocket along the exposed side or outer surface of the binder.

2. Description of the Related Art

Binders are generally designed to hold loose papers between its covers. Unfortunately, these binders have limited capacity and cannot hold much else besides papers and slim items that are no bigger that the size of the binder covers. For example, oversized papers that are bigger than the binder covers can not be inserted into the interior pockets of the binder without first being folded. Furthermore, with a three ring binder, the oversized papers have to be first three hole punched along the edge so that it may be held by the three ring binder. Accordingly, with today's binders, storing oversized papers can be tedious; and the undesirable fold lines and/or holes, which may be made on oversize papers, can constitute a serious disadvantage.

Still further, today's binder have limited capacity between its covers; that is, only certain number of sheets can be held by the binder. Moreover, the binders are limited to holding relatively small slim items, such as papers, credit cards, pictures, pens, small calculators, and etc. For bulkier items, such as roll of tape, markers, key-chains and the like, a user generally needs another bag, such as a backpack, to carry these items around. In other words, a user needs another bag to carry bulkier items around. Otherwise, if a user attempts to store the bulkier items in the binder, the covers will likely buckle because they are generally made of rigid materials and are unable to conform to the shapes of the bulkier items.

Yet another disadvantage with today's binders is the cumbersome access to the items held within the binders. For example, for a typical zipper type three ring binder, a user has to go through the cumbersome steps of undoing the zipper, and unlatching the three ring holders, just to have access to the papers held in the binder. In other words, there are numerous shortfalls with today's binders, such as, inability to hold oversized papers, limited capacity, and cumbersome access to the items held within the binder, just to name a few.

In an attempt to overcome some of the above short comings, U.S. Pat. No. 5,411,294 issued to Monzyk, discloses a double cover ring binder to hold both three holed and non-three holed materials. However, Monzyk does not disclose easy access to the materials or the ability to hold oversized papers without having to fold them first. As another example, U.S. Pat. No. 5,720,564 issued to Winzen, discloses a binder with a label holder that is suitable for receiving conventional 8½ inches by 11 inch paper. However, the label holder cannot hold bulkier items nor oversized papers that extend from the edges of the front to back cover.

Therefore, there still is a need for a binder that can hold oversized papers without having to fold them first and to hold bulkier items, with greater capacity, and easy access to the items.

OBJECT AND SUMMARY OF THE INVENTION

A general object of the present invention is to provide one or more exterior pockets that extend along the exposed side of the binder to provide additional capacity to securely hold oversize sheets, items that are too bulky, or excess items that would not fit inside the binder. In accordance with one aspect of the present invention, these and other objectives are accomplished by providing: a front cover; a back cover; said front and back covers having inner edges flexibly secured to one another at a spine, and outer edges spaced outwardly from said spine; and one or more pockets, each having outer edges secured to the outer edges of said covers and having an intermediate portion extending freely over said spine; whereby papers of a predetermined size, comparable to or slightly less in extent than each of said covers, may be mounted within said binder, and larger papers up to sizes having an extent of twice said predetermined size may be stored in said pocket without creasing said larger size papers.

As an additional aspect of the invention, the lower edge of said pocket may be temporarily or permanently secured to the lower edge of the covers and spine of the binder.

In the event that oversize papers need not be accommodated, the exterior pocket or pockets may be secured to the spine, thus providing easily accessible smaller pockets on the outer surface of the front and/or back covers of the binders.

In accordance with another embodiment of the present invention, an elastic cord may be coupled along the opening of the pocket to provide additional tension along the pocket opening to securely seal the items held in the pocket. The upper edge of the pocket may also be provided with a bead or even VELCRO® hook and loop material to close the pocket.

The above described and many other features and attendant advantages of the present invention will become apparent from a consideration of the following detailed description when considered in conjunction with the accompanying drawings.

BRIEF DESCRIPTION OF THE DRAWINGS

Detailed description of the preferred embodiment of the invention will be made with reference to the accompanying drawings:

FIG. 4 is a perspective rear view of another exemplary binder in an open position, further showing a cord attached to an opening of an exterior pocket.

FIG. 5 is a cross-sectional view of the invention taken along line 5—5 of FIG. 5.

DETAILED DESCRIPTION OF THE PREFERRED EMBODIMENTS

Disclosed herein is a detailed description of a best presently known modes of carrying out the invention. This description is not to be taken in a limiting sense, but is made merely for the purpose of illustrating the general principles of the invention. The section titles and overall organization of the present detailed description are for the purpose of convenience only and are not intended to limit the present invention.

Figure 1:
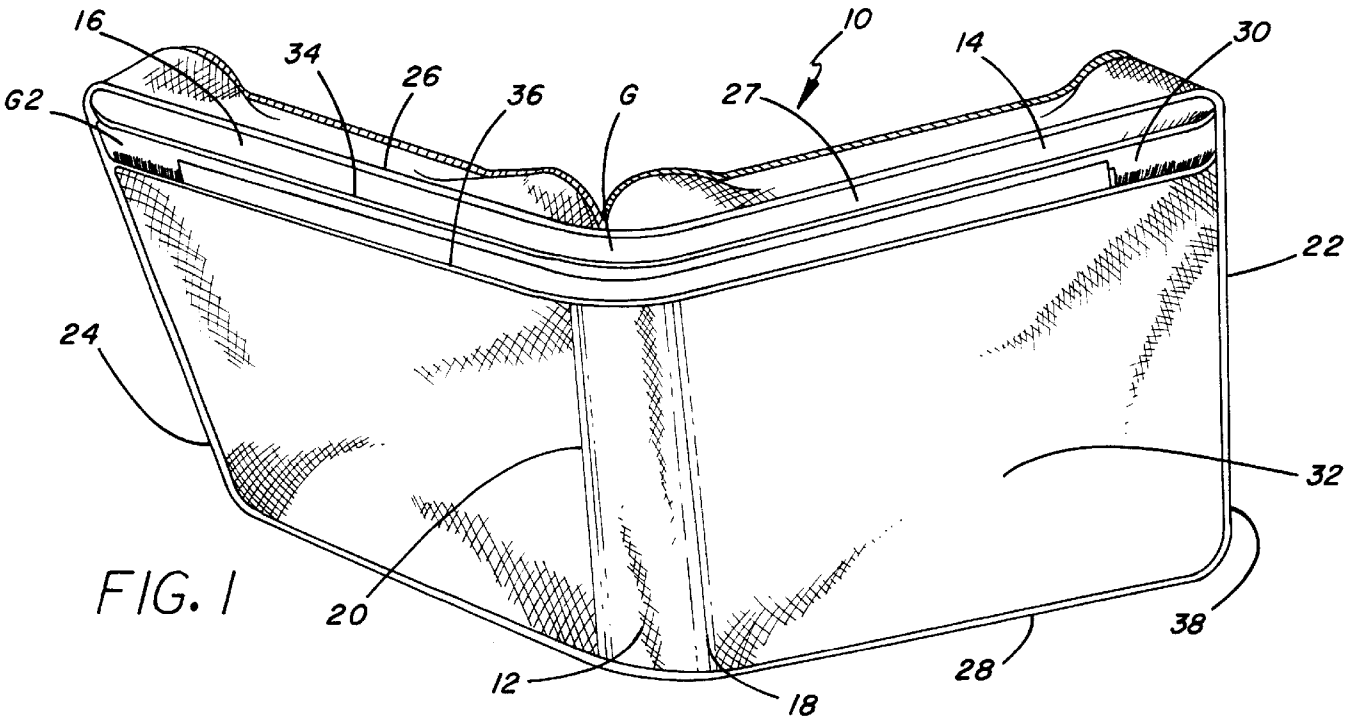
FIG. 1 is an exterior view of an exemplary binder illustrating the principals of the invention in an open position.
Figure 3:
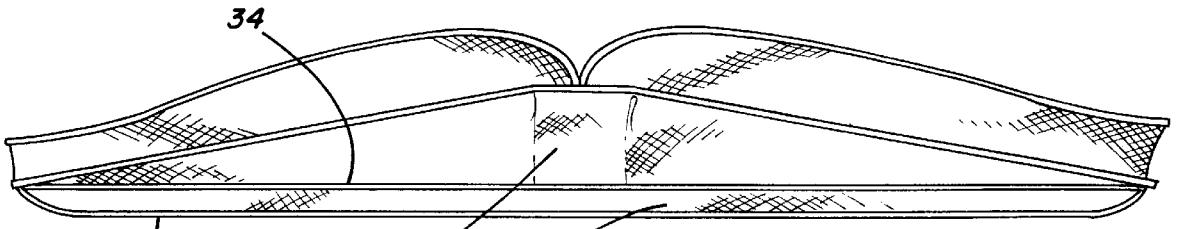
FIG. 3 is a perspective rear view of an exemplary binder in an open position, along with exterior pockets that are open.
Figure 2:
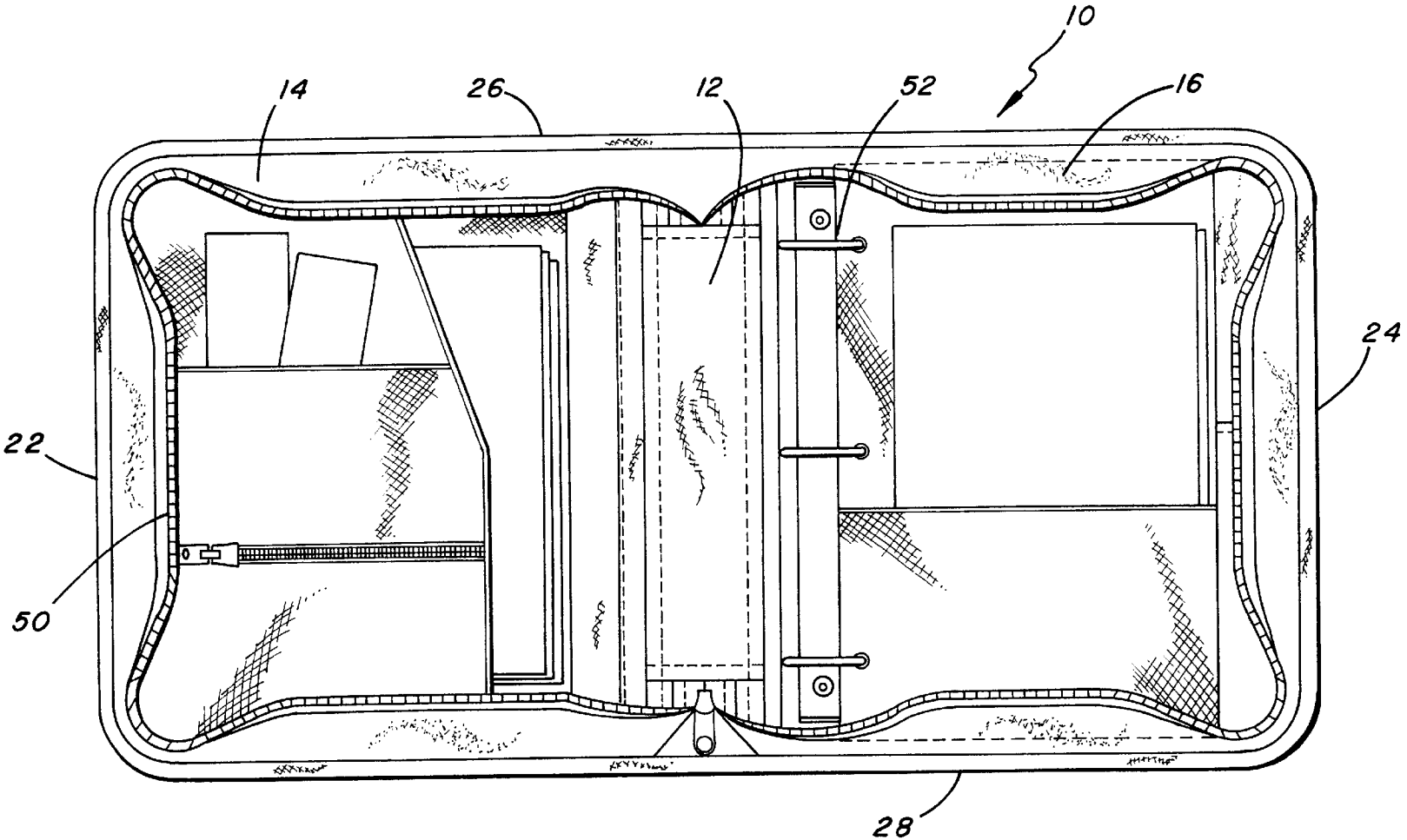
FIG. 2 is a perspective interior view of an exemplary binder in an open position.

As illustrated by way of example in FIGS. 1–3, a binder 10 is shown, which is constructed to hold standard size sheets of 8½ by 11 inches, or A-4 size paper. The binder 10 includes a spine 12, a front cover 14, and a back cover 16 connected to the opposite edges of the spine 12, along fold lines 18 and 20, respectively. The front and back covers and the spine define the outer edges of the binder 10, i.e., a front edge 22, back edge 24, top edge 26, and bottom edge 28. The front and back covers 14,16 have a preferred width of about eleven inches and height of about thirteen inches. The binder 10 may also be sized to accommodate paper sheets larger or smaller than 8½ by 11 inches. For example, typical carry-type organizers and calendars are usually about 5 inches by 7 inches, while binders for photo albums can be about 12 inches by 15 inches.

The front and back covers and the spine, each has an inner base (not shown) to give respective covers and the spine a body with the dimensions as discussed above. The respective inner bases provide structural support, yet they are flexible so that the covers are able to contour around the items being held with some resistance. Preferably, the inner base is made of suitable paper board or other suitable material. The respective inner bases are also enclosed by a suitable material that is known to one who is ordinarily skilled in the art, to form an outer covering; preferably a fabric or plastic sheet material is used to enclosed the inner bases. As shown most clearly in FIG. 1, a continuous layer 27 of fabric material is preferably used to cover the entire exterior side of the binder 10; that is, the continuous fabric 27 extends from the front and back edges 22, 24, and from the top and bottom edges 26, 28 of the binder. Still further, a thin foam layer (not shown) may be provided between the inner base and the enclosed fabric to give the binder a softer feel.

As illustrated by way of example in FIG. 1, in accordance with the preferred embodiment, the exposed side of the binder 10 is substantially covered by a first pocket layer 30 extending from the front edge 22 to the back edge 24, and from the bottom edge 28 to near the top edge 26, leaving a first leading edge 34 slightly shorter than the top edge 26. Likewise, the first pocket layer 30 is also substantially covered by a second pocket layer 32, leaving a second leading edge 36 slightly shorter than the first leading edge 34. To form the pockets, the pocket layers 30, 32 are coupled along the three edges 22, 28, and 24 of the binder 10. Alternatively, it is within the scope of the present invention to have the exposed pocket 30, 32 not fully extending between the front and back edges 22, 24, for example, to hold unfolded legal size papers.

As illustrated by way of example in FIG. 3, when the binder 10 is in a substantially open position, the first leading edge 34 of the first pocket 30 opens up to form a gap "G1", with large capacity to hold variety of items. That is, the pocket layer 30 is no longer juxtaposed to the continuous fabric 27. Likewise, the second leading edge 36 of the second pocket 32 opens up to form a gap "G2." Although the embodiment illustrated in FIGS. 1–3, show two pocket layers 30, 32, it is within the scope of the present invention to have a single pocket or more than two pockets. Still further, the first and second leading edges, 34, 36, alternatively may be adjacent to the top edge 26 (not shown). Another alternative embodiment would be to have the second pocket 32 inverted with the second leading edge 36 configured near to the bottom edge 28, and the second pocket 32 continuously secured to the first pocket 30 near the first leading edge 34, i.e., the gap G1 is form near the top edge 26, and the gap G2 is formed near the bottom edge 28. Yet another alternative embodiment is to have the first pocket 30 covering the top half of the binder with the gap G1 along the center line between the top and bottom edges, and the second pocket 32 covering the bottom half of the binder with the gap G2 next to the gap G1, thus forming two long thin pockets, or a single big pocket with a central slit opening.

Once the pockets 30, 32 are in the open positions, i.e., gaps G1 and G2 are formed, as shown in FIG. 3, a variety of items that would not fit between the binder covers may be inserted into the pockets. That is, the pockets 30, 32 provide additional capacity to hold items that may be too bulky or excess items that would not fit between the binder covers. For example, to fit an oversized paper, such as 11 by 17 inches, that is larger than the binder cover, the paper has to be folded first and perhaps three holes needs to be punched so it can be secured into the three ring clipper. Consequently, to carry the oversized paper within the binder, the paper now has an undesirable fold line and holes punched therethrough. With the present invention, the oversized paper may be inserted and securely held in either pockets 30, 32, without the need for folding or hole punching. Additionally, large number of sheets may be securely inserted into the pockets; for example, a sample binder with the pockets, as illustrated in FIGS. 1–3, have been tested to securely hold up to 100 sheets of paper in each pockets.

Furthermore, when the binder 10 is substantially opened, the gaps G1 and G2 are wide so that even bulkier items unable to fit between the binder covers may be inserted into the pockets. For example, bulkier items such as, books, note pads, ruler, eyeglass carrying case, key chain, makers, small stapler, white-out container, scotch-tape, and even a T-shirt may be inserted into the pockets, to name a few. That is, most items that would be normally carried in a backpack may be conveniently carried through the pockets of the binder.

Once the items have been inserted into the pockets, the binder covers are closed to securely hold the items in their place. That is, as the covers are closed, the gaps G1 and G2 close in, and the pocket layers 30, 32 tightly contours around the exposed side of the binder with the items therebetween. In particular, the leading edges 34, 36 form a tight seal against the exposed side of the binder to ensure that the items within the pockets are held in place.

With regard to material, the pocket layers 30, 32 should be flexible and may be of resilient or expandible material to contour around the shapes of the items being held, yet elastic to return to its original shape once the items are removed. Further, the pocket layers 30, 32 are preferably treated with UV coating to protect against harmful effects of the ultra violet rays from the sun. Still further, the layers 30, 32 are preferably treated with water retardant so that moisture do not penetrate through the pocket layers to dampen the items held within the pockets. In this regard, the layers 30, 32 may be made of Nylon, Polyester, and Polyvinyl chloride, with fabric being the preferred material. Although this embodiment is directed to the pocket layers made of opaque or non-translucent materials, it is within the scope of this invention to use translucent or mesh materials so that a user can see the items being held within the pockets.

To have an aesthetically pleasing finish, the pocket layers 30, 32 may be coupled along the three edges 22, 28, and 24 by variety of ways. Preferably an edge binding (thin strip) 38 is wrapped around the four edges of the binder then sewn together, to provide a smooth high quality finish around the edges of the binder. In particular, the fabric layer 27, and the first and second pocket layers 30, 32, are joined along the three edges 22, 28, and 24, which are wrapped around by the edge binding 38, then sewn or stitched together.

As illustrated by way of example in FIG. 2, the interior of the binder 10 has a zipper 50 to open and close the binder, and a three ring mechanism 52 to hold punched papers. The ring mechanism 52 is releasably coupled to back cover 16, i.e., it may be removed from the binder if the ring mechanism 52 is not needed. The front and back covers have number of interior pockets to hold generally flat items.

Another embodiment of the present invention is illustrated by way of example in FIG. 4 and FIG. 5. In this embodiment primed reference numerals are employed where the element discussed is substantially same as discussed above. Here, a pocket layer 30' is shown with a leading edge 34', similar to the pocket discussed above; with a plurality of channels 60 coupled along the leading edge 34'. These channels may be formed of loops of strip fabric. Running through the channels 60 is a cord 62 that extends from the front edge 22' to the back edge 24'. Preferably, the cord 62 is an elastic cord. When the binder is closed as shown in FIG. 5, the gap G1 is closed and, the elastic cord 62 is fully extended, which provides sufficient tension along the leading edge 34', to provide additional tension along the leading edge 34' to hold the items within the pocket in place. However, when the binder is open, the tension in the elastic cord 62 is released and the pocket opens to give a user easy access to the pocket so that items may be easily placed or removed from the pocket. The elastic cord 62 is preferably made of material that retains its elasticity even after many cycles of stretching and contraction, such as a thin bungee cord, for example. To securely hold the ends of the bungee cord to the binder, a loop of fabric may be provided at each end of the bungee cord, and the cord may extend through the loop of fabric and fold back for a short distance along the cord.

Alternatively, the plurality of channels 60 may be a continuous channel that is coupled along the leading edge 34' with the cord 62 running therethrough. Still further, there may be a plurality of cords 62 running parallel along the leading edge 34'. Yet another alternative is to have a zipper coupled along the leading edge 34' to close and open the pocket.

Although the present invention has been described in terms of the preferred embodiments above, numerous modifications or additions to the above-described preferred embodiments would be readily apparent to one skilled in the art. Thus, by way of example and not of limitation, the binder is preferably sized to hold standard eight and a half by eleven inches sheets of paper or A-4 paper. However, the binder may also be sized to accommodate sheets larger or smaller than eight and a half inches by eleven inches. For example, typical carry-type organizers and calendars are usually about five inches by seven inches, while binders for photo albums can be about twelve inches by fifteen inches. Accordingly, the present invention is not limited to the specific embodiments illustrated and described hereinabove. With respect to the claims, it is applicant's intention that the claims not be interpreted in accordance with the sixth paragraph of 35 U.S.C. § 112 unless the term "means" is used followed by a functional statement.

What is claimed is:

1. A binder with an exposed pocket, comprising:

a front cover;

a back cover;

a spine coupling the front and back covers along fold lines, wherein edges of a binder are defined by a top, bottom, front, and back edges;

a pocket having outer edges coupled to the front, back, and bottom edges of the binder with a leading edge free;

a channel coupled to the leading edge of the pocket; and an elastic cord running through the channel;

whereby papers of a predetermined size, comparable to or slightly less in extent than each of said covers, may be mounted within said binder, and larger papers up to sizes having an extent of twice said predetermined size may be stored in said pocket without creasing said larger size papers.

2. The binder with an exposed pocket as defined in claim 1, wherein the pocket is made of a fabric material.

3. A versatile binder assembly comprising:

a front cover;

a back cover;

said front and back covers having inner edges flexibly secured to one another at a spine, and outer edges spaced outwardly from said spine;

a first pocket arrangement including sheet material having outer edges secured to the outer edges of said covers and having an intermediate portion extending over said spine; and a plurality of channels coupled along a top edge of said first pocket arrangement, and an elastic cord passing through said plurality of channels, wherein opposing ends of the elastic cord are coupled to outer edges of said covers, respectively.

4. A versatile binder assembly as defined in claim 3 wherein said sheet material extends freely over said spine;

whereby papers of a predetermined size, comparable to or slightly less in extent than each of said covers, may be mounted within said binder, and larger papers up to sizes having an extent of twice said predetermined size may be stored in said first pocket arrangement without creasing said larger size papers.

5. A versatile binder assembly as defined in claim 3, wherein said first pocket arrangement is coupled to said covers along a bottom edge of said first pocket, to retain said larger papers in said first pocket arrangement.

6. A versatile binder assembly as defined in claim 3, wherein the elastic cord is a bungee cord.

7. A versatile binder assembly as defined in claim 3, wherein the binder is a ring binder.

8. A versatile binder assembly as defined in claim 7, wherein the ring binder has an extent greater than 8½ by 11 inches whereby it is adapted to hold paper such as 8½ by 11 inches or A-4 size paper between the front and back covers.

9. A versatile binder assembly as defined in claim 3, wherein the first pocket arrangement is made of fabric material.

10. A versatile binder assembly as defined in claim 3, wherein the front and back covers and the spine each include a respective interior base member.

11. A versatile binder assembly as defined in claim 10, wherein the interior base member is substantially flexible.

12. A versatile binder assembly as defined in claim 3, wherein the respective interior base members are covered by a fabric material, whereby soft binder covers are provided.

13. A versatile binder assembly as defined in claim 5, includes an edge binding coupled along the outer and bottom edges of the said pocket arrangement.

14. A versatile binder assembly as defined in claim 3, includes a second pocket arrangement having outer edges secured to the outer edges of said covers.

15. An outer exposed pocket binder, comprising:

a ring binder with outer edges defined by a top, bottom, front, and back edges;

an outer exposed pocket coupled along the bottom and near the front and back edges of the binder, wherein the outer exposed pocket extends continuously along the binder; and a channel coupled to the free leading edge of the pocket, and a cord running through the channel, wherein ends of the cord are coupled to the front and back edges, respectively, of said binder.

16. The pocket binder as defined in claim 15, wherein the outer exposed pocket has a free leading edge near the top edge of the binder.

17. The pocket binder as defined in claim 15, including a ring mechanism for holding paper mounted within said binder.

18. A binder assembly comprising:

a front cover;

a back cover;

a spine in between the front and back covers, the spine coupling to the front cover and the back cover along a front fold line and a back fold line, respectively, to form a binder;

the binder having a top, bottom, front, and back edges;

a first pocket having outer edges coupled substantially along the front, back, and bottom edges of the binder with a leading edge free, wherein the first pocket is continuous between the first and back covers of the binder; and at least one channel coupled along the leading free edge of the first pocket, and an elastic cord passing through the at least one channel, wherein opposing ends of the elastic cord are coupled to the front and back edges of the covers, respectively.

19. A binder assembly as defined in claim 18, includes a second pocket juxtaposed to the first pocket, the second pocket coupled substantially along the front, back, and bottom edges of the binder, wherein the second pocket is continuous between the first and back covers of the binder.

20. A binder assembly as defined in claim 18, wherein the elastic cord is a bungee cord.

21. A versatile binder assembly comprising:

a front cover;

a back cover;

said front and back covers having inner edges flexibly secured to one another at a spine, and outer edges spaced outwardly from said spine;

a first pocket having outer edges secured to the outer edges of said covers and having an intermediate portion extending over said spine; and at least one channel coupled along a top edge of said first pocket, and an elastic cord passing through the at least one channel, wherein opposing ends of the elastic cord are coupled to outer edges of the covers, respectively.

22. A versatile binder assembly as defined in claim 21, wherein the elastic cord is a bungee cord.

23. An outer exposed pocket binder, comprising;

a binder with outer edges defined by a top, bottom, front, and back edges; and an outer exposed pocket coupled along the bottom and near the front and back edges of the binder; and a channel coupled to the free leading edge of the pocket, and a cord running through the channel, wherein ends of the cord are coupled to the front and back edges, respectively, of said binder.

* * * * *